United States Patent [19]

Lafontaine

[11] Patent Number: 4,625,456

[45] Date of Patent: Dec. 2, 1986

[54] POWER DOOR OPERATING DEVICE

[76] Inventor: Lucien Lafontaine, 755 Mont Pellier, Apt. No. 1105, Ville St-Laurent, Quebec, Canada, H4L 4H1

[21] Appl. No.: 831,292

[22] Filed: Feb. 20, 1986

[51] Int. Cl.[4] ..... E05F 11/00

[52] U.S. Cl. ..... 49/358; 49/199; 49/360

[58] Field of Search ..... 49/199, 200, 358, 28, 49/360; 105/163; 104/106, 107

[56] References Cited

U.S. PATENT DOCUMENTS

| | | | |
|---|---|---|---|
| 3,202,415 | 8/1965 | Lodge | 49/199 X |
| 3,797,171 | 3/1974 | Farmer | 49/199 X |
| 4,065,878 | 1/1978 | Tsugane | 49/360 |

*Primary Examiner*—Kenneth Downey

*Attorney, Agent, or Firm*—Neil W. McDermid; William H. James

[57] ABSTRACT

A power operating device for use with vertically sliding garage doors provides a friction drive roller that can slide laterally to take into account variations in space between the side of the upper panel of the door and the guide tracks when the door is open or closed. The operating device includes a housing with a reversable motor and gear reduction driving a drive shaft, a drive roller formed of resilient material connected to the drive shaft and having a contoured surface to ride on an outside surface of one guide track, pinch means to pinch the one guide track between one of the guide rollers of the door and the drive roller such that rotation of the drive roller frictionally drives the sliding door in the guide tracks, and attachment means on the housing for connection to the sliding door, the improvement comprising slidable connection between the drive roller and the drive shaft to take into account lateral displacement of the sliding door between open and closed position, and slidable adjustable base for the attachment means for different thicknesses of sliding door and the guide tracks.

5 Claims, 8 Drawing Figures

POWER DOOR OPERATING DEVICE

The present invention relates to power door openers, more specifically the present invention provides an improved power door operating device for use with a vertical sliding door, such as a garage door, mounted on two guide tracks.

Powered garage door openers are available in several different types. Most garage doors have a series of horizontally divided panels supported on two guide tracks, one on each side. Guide rollers at the sides of the horizontal panel ride in the guide tracks allowing the door to open vertically. In general the guide tracks have curves above the door opening extending the tracks substantially horizontal, so when the door is in the open position, it is substantially horizontal. In locations where there is sufficient head room, the track may extend vertically upwards so that the door simply rises vertically above the opening.

One type of powered door opener is attached to one side of the door and utilizes a resilient friction drive on one of the guide tracks. This type of opening device is clamped to the door's upper guide roller that runs in the guide track. The system provides a motorized unit that is bolted to the door so that it moves with the door and does not require a conventional push pull type operator such as a T-rail, cable, chain, door arm etcetera. Thus this type of door opener reduces the number of component parts. Garage doors generally use springs to counter balance the weight of the door and doors having the type of opening device referred to, require a counter balance.

One problem with the side driven door opener is variations in the space between the side of the upper panel of the door and the guide tracks. The space is not always the same when the door is open and closed. The shafts of the guide rollers attached to the door can slide laterally to cope with these variations, however, the drive unit does not have the ability to slide laterally and variation in this space can cause the drive roller to come off the guide tracks.

It is an aim of this invention to overcome this problem by having a friction drive roller that can slide laterally on a drive shaft to take into account any variations in the space between the door and the guide track.

The present inventon also aims to provide a power door operating device that can mount on any thickness of door and can be adjusted to suit different track sizes and radii.

A still further aim of the present invention is to provide a power door operating device that has a clamp containing two limit switch trip fingers that can be positioned at any desired location on the track and adjusted so that two limit switches are tripped, the first limit switch to turn off the reversing action of the motor and the second limit switch to stop the motor.

The present invention provides in a power door operating device for use with a vertical sliding door mounted on two guide tracks, one on each side of the door, the door having guide rollers at each side to rotate inside the guide tracks, the operating device including a housing having therein a reversable motor and gear reduction driving a drive shaft extending out of the housing; a drive roller formed of resilient material connected to the drive shaft, the drive roller having a contoured surface to ride on an outside surface of one guide track; pinch means to pinch the one guide track between one of the guide rollers of the door and the drive roller such that rotation of the drive roller frictionally drives the sliding door in the guide tracks; and attachment means on the housing for connection to the sliding door; the improvement comprising: slidable connection between the drive roller and the drive shaft to take into account lateral displacement of the sliding door between open and closed positions of the sliding door, and slidably adjustable base for the attachment means for different thicknesses of sliding door and guide tracks.

In other embodiments, the slidable connection between the drive roller and the drive shaft comprises a drive shaft with a square cross section, and a square hole in the drive roller to allow the drive roller to slide on the drive shaft and transmit rotational movement. The pinch means in one embodiment comprises a toggle system with a first lever pivoted about the drive shaft, a second lever at one end hooking onto a shaft supporting the guide roller and having spring tension connection at the other end of the first lever to take into account different thicknesses of the guide track, and supply sufficient pressure when the toggle system is in a driving position for the drive roller to move the door.

In a still further embodiment, two spaced apart limit switches are located on the housing, and two spaced apart adjustable trip fingers adapted for mounting on the guide track, the trip fingers adapted to activate the limit switches to cancel reversing action of the motor and to turn off the motor.

In drawings which illustrate embodiments of the invention;

Figure 1:
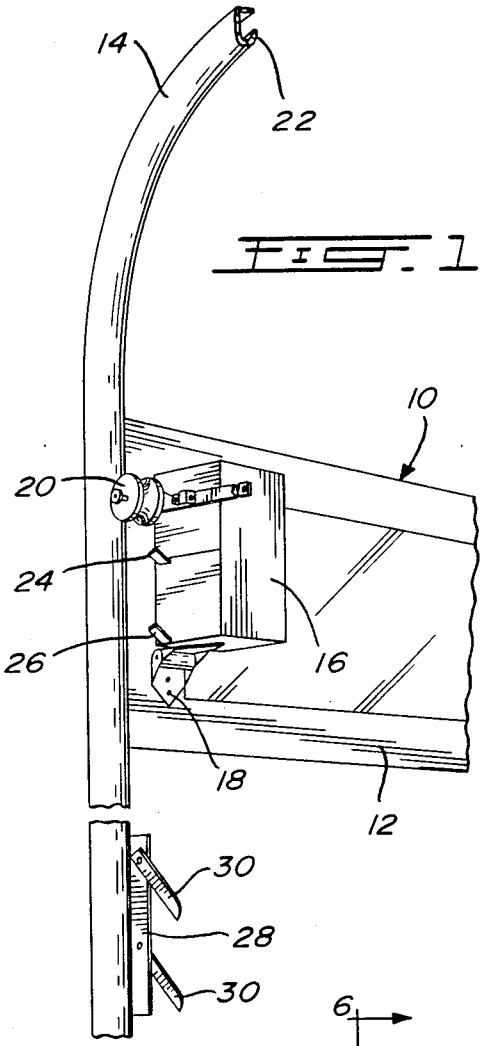
FIG. 1 is an isometric view illustrating a power door operating device according to the present invention with a clamp strip attached to a portion of the guide track.

Referring now to FIG. 1, one side of a garage door 10 is shown comprising a series of panels 12 hinged together at horizontal edges and having rollers (not shown) which fit into guide tracks 14 on each side of the door 10. The guide track 14 has a curve above the door and then extends substantially horizontal for a distance sufficient to hold the complete door when it is raised. A power door operating device 16 is shown attached to the door by a mounting bracket 18, the operating device 16 has a drive roller 20 with a peripheral groove at its approximate center which rides on the outside curved flange 22 of the track 14. Details of the power door operating device 16 will be described hereafter.

Two limit switches 24 and 26 are positioned on the operating device substantially in line with the drive roller 20, and a clamp strip 28 is clamped to the guide track 14, the clamp strip 28 has two trip fingers 30 which are positioned to trip the limit switches 24 and 26 when the door is in the closed position.

Figure 2:
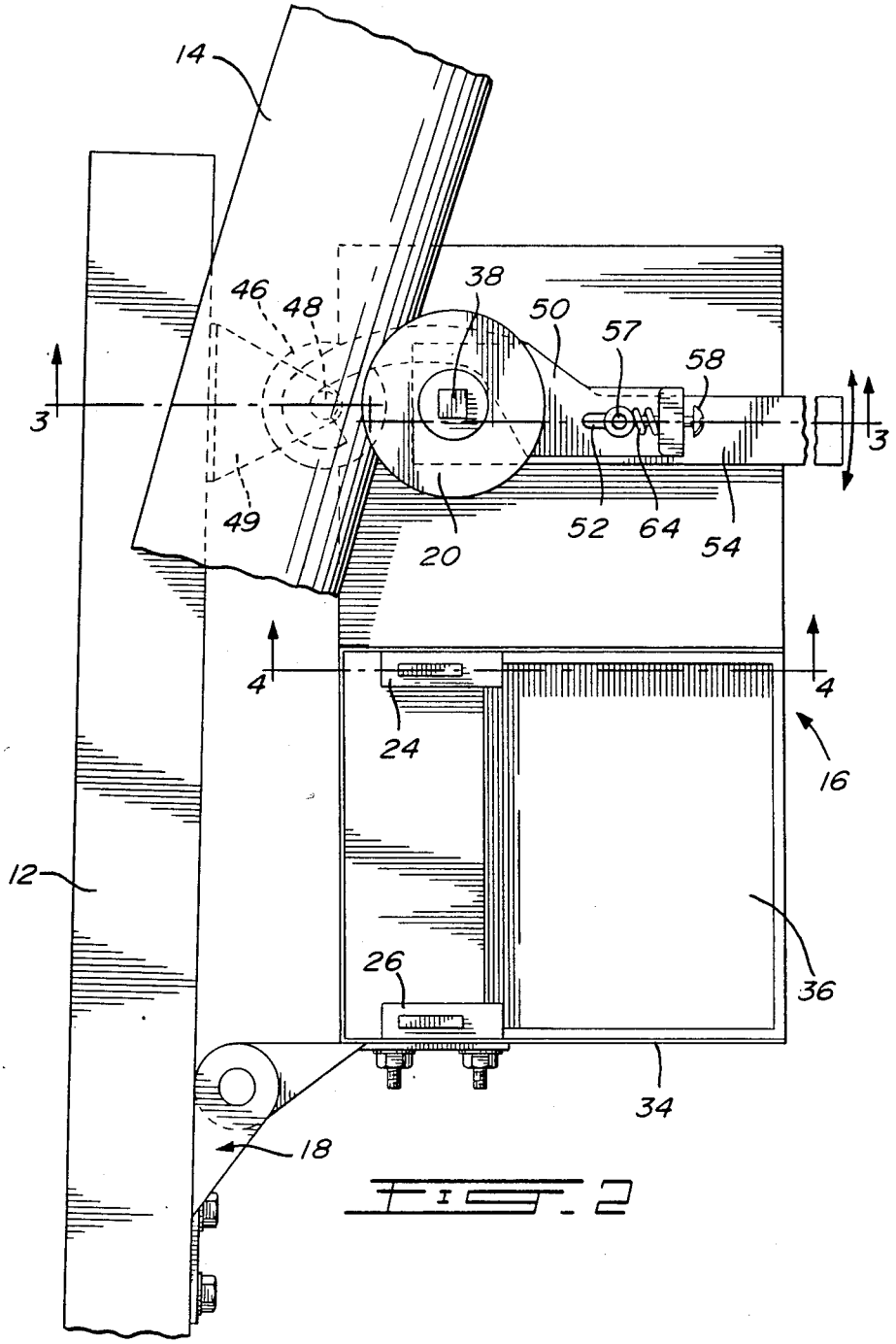
FIG. 2 is a side elevational view of a powered door operating device as illustrated in FIG. 1.
Figure 3:
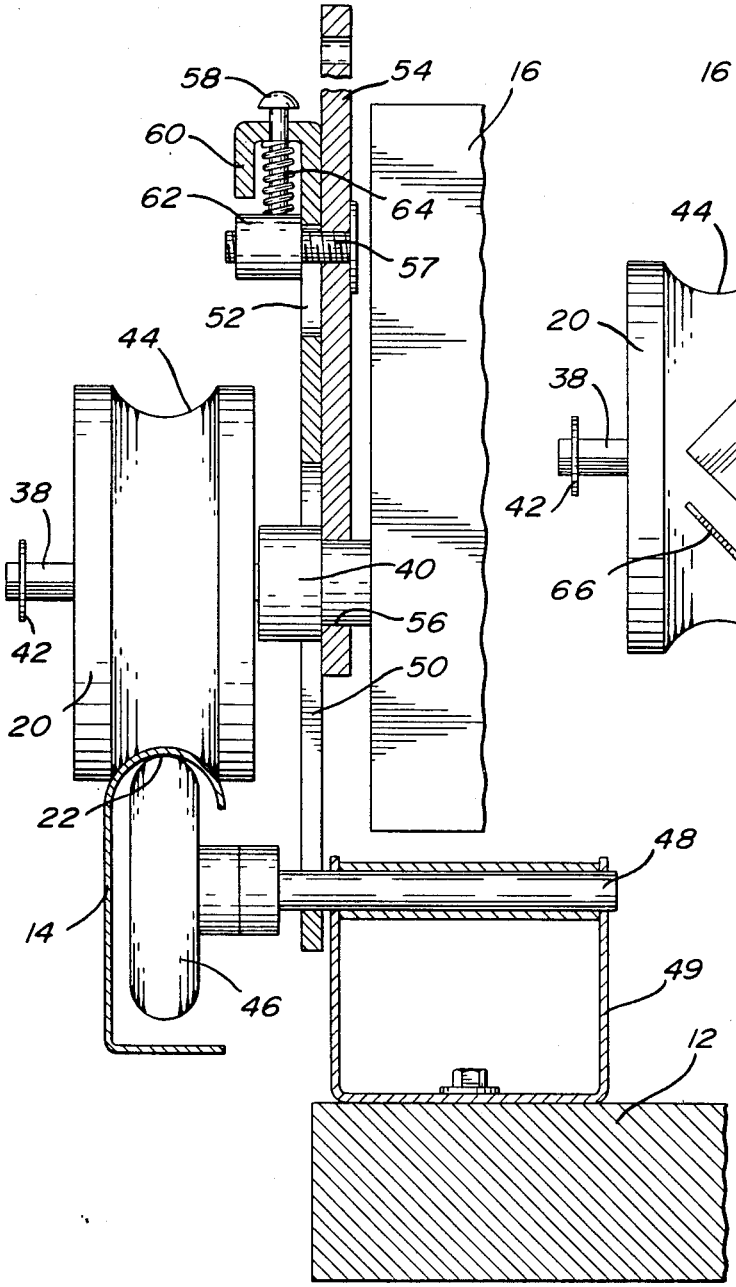
FIG. 3 is a cross sectional view taken at line 3—3 of FIG. 2.
Figure 4:
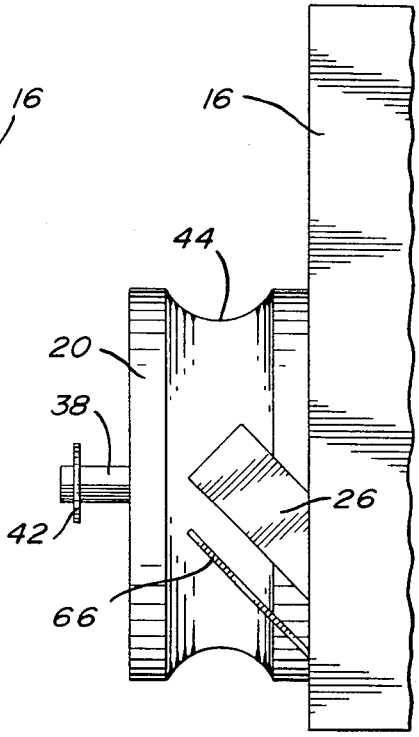
FIG. 4 is a cross sectional view taken at line 4—4 of FIG. 2.

The door operating device is illustrated in FIGS. 2, 3 and 4 and has a housing 34, generally a sheet metal construction, containing a reversable electric motor 36 which through a reduction gear, preferably a worm gear, drives a drive shaft 38. The drive shaft 38 has a collar 40 adjacent the housing 34, and the shaft itself has a square cross section fitting into a square hole at the center axis of the drive roller 20. At the end of the square drive shaft 38 is a spring clip 42 to prevent the drive roller 20 from sliding off the drive shaft 38, however, the drive roller 20 can move backwards and forwards on the drive shaft 38 taking up any lateral space variations between the sides of the upper panel 12 and the guide track 14 when the door is in the open and closed position. The peripheral groove 44 in the drive roller 20 fits over the outside of the curved flange 22 of the guide track 14, and so the curved flange 22 moves the drive roller 20 backwards and forwards on the drive shaft 38 as required to take lateral space variations into consideration.

The upper panel 12 of the sliding door 10 has guide rollers 46 at each side which run inside the guide tracks 14. The guide rollers 14 rotate on a shaft 48 which is held by an attachment bracket 49 to the upper panel 12. As can be seen in FIGS. 2 and 3, the top guide roller 46 is positioned directly in line with the drive roller 20 and the flange 22 of the guide track 14 is squeezed between the top guide roller 46 and the drive roller 20. This squeezing or pinching action allows the drive roller 20 to frictionally drive the operating device 16 on the guide track 14. The shaft 48 of the guide roller 46 is gripped by a hook lever 50 which has a slot 52 at the top end. A toggle lever 54 has a pivot hole 56 at its base to pivot about the drive shaft 38. The handle of the toggle lever 54 extends out beyond the operating device. A long handle provides better lever action for pinching and thus produces a higher pressure without undue force required to activate the lever 54. A pin 57 through toggle lever 54 extends above the drive roller 20 through the slot 52 in the hook lever 50, and a machine screw 58 extend through a hole in a top channel portion 60, forming part of the hook lever 50, to a collar 62 on pin 57. A coiled spring 64 on the machine screw 58 presses downward which in turn pulls up the hook lever 50, and hence the guide roller 46, into firm contact, and pinches the flange 22 of the track guide 14 between the guide roller 46 and the drive roller 20. The spring 64 has sufficient compression force and movement to allow variations in thickness of the flange 22, but still permit a friction drive between the drive roller 20 and the track guide 14. The toggle lever 54 is positioned approximately upright, so that the drive roller 20 and the guide roller 46 are approximately in line with the toggle lever 54. When in the upright position, the spring 64 is compressed to form the pinching action on the guide track 14. If the garage door 10 is to be operated by hand, it is merely necessary to move the toggle lever 54 to one side, which disengages the guide roller 46 so there is no friction between the drive roller 20 and the flange 22 of the track guide 14. The door can then be opened manually. Whereas one toggle system is shown by way of an embodiment. Many known types of pinching mechanisms may be used, provided the pinching action can be relatively easily engaged and disengaged.

Figure 5:
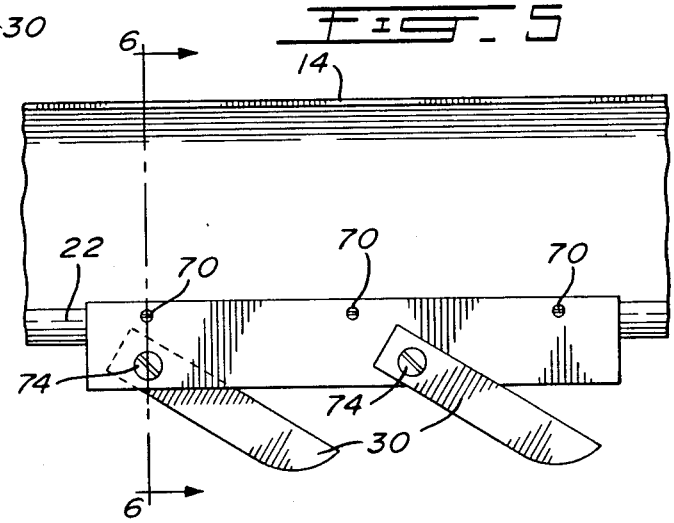
FIG. 5 is a side elevational view showing a clamp strip attached to a section of guide track.
Figure 6:
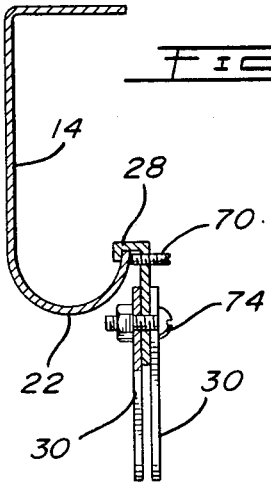
FIG. 6 is a cross sectional view taken at line 6—6 of FIG. 5.

As can be seen in FIG. 2, the limit switches 24 and 26 are spaced three or four inches apart on the housing 34 and follow behind the drive roller 20. Each limit switch 24 and 26 has a flexible operating strip 66 as shown in FIG. 4. The clamp strip 28 is shown in FIGS. 5 and 6 and has a U-shaped flange with machine screws 70 which when tightened, grip the clamp strip 28 to the edge of the curved flange 22 of the track guide 14. Limit switch trip fingers 30 are attached by a nut and a bolt 74 to the clamp strip 28 and, as shown in FIG. 5, extend at an angle providing a slope for activating the limit switch flexible operating strip 66. The angle of this slope for the trip fingers 30 may be varied to take into account the different radius of the curved portion of the guide track 14. The trip fingers 30 are positioned at the correct height to take into account the position of the limit switch flexible operating strip 66. Thus variation in door thickness and variation in track guide size may be taken into account by merely repositioning the trip fingers 30. The limit switches 24, 26 are arranged that when the first limit switch 24 is tripped, it disengages the reversing feature of the motor 36, and when the second limit switch 26 is tripped, the motor 36, is turned off. Thus the two limit switches are needed to prevent the door reversing when it reaches the end of its travel, and to turn off the motor.

Figure 7:
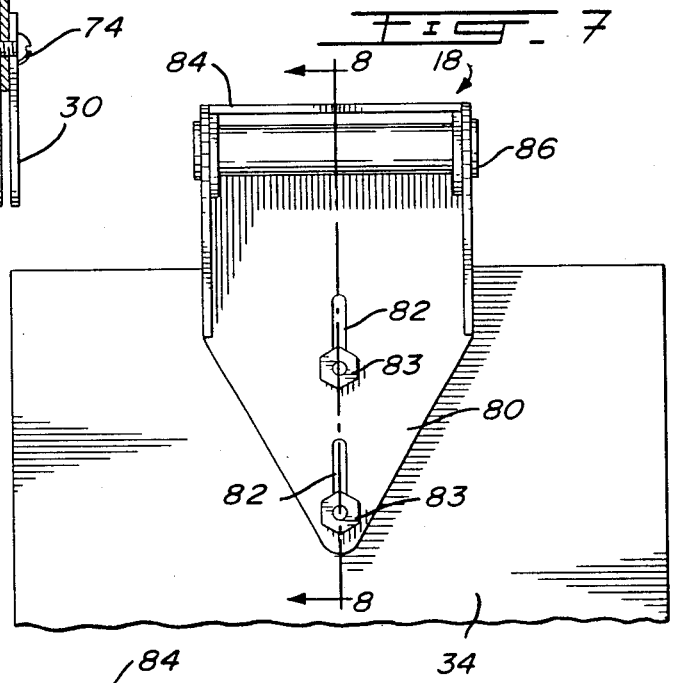
FIG. 7 is an end view showing an adjustable connection for attaching the power door operating device to a door.
Figure 8:
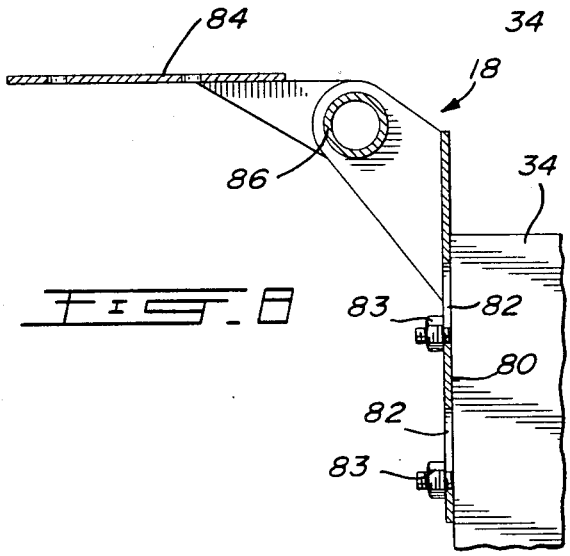
FIG. 8 is a cross sectional view taken at line 8—8 of FIG. 7.

The mounting bracket 18 has a flange 80 with two slots 82 for bolts 83 to attach the bracket 18 to the housing 34. The slots 82 allow for variation in height of the right angle flange 84. The arrangement illustrated in FIGS. 7 and 8 allows for different thicknesses of door panels to be easily attached to the door operating device 16, and still keep the door operating device 16 at the substantially correct angle on the track 14. The angle is important to ensure that the idler roller 50 and drive roller 20 are substantially in line gripping the flange 22 on the track guide 14. A pivot 86 is provided between the mounting flange 80 and the right angle flange 84 to allow the power operated unit to follow a curve in the track guide 14 and the door to easily follow this curve.

In one embodiment, the overall weight of the unit is approximately 10 to 12 lbs. and the electrical controls for reverse operation are located in the housing 34. A safety feature is installed in the housing 34, so that if the door hits an obstruction when closing, it automatically reverses. One type of automatic reversing mechanism is disclosed in my U.S. Pat. No. 3,633,313. A radio control unit may be fitted to the operating device by attachment to the housing, and an electrical cable and/or push button operated lead may be provided, either supported on a wire above the door, or looped in some other way so that they do not interfere with the operation of the door.

Various changes may be made to the embodiments shown herein without departing from the scope of the present invention which is limited only by the following claims.

The embodiments of the invention in which an exclusive property or privilege is claimed are defined as follows:

1. In a power door operating device for use with a vertical sliding door mounted on two guide tracks, one on each side of the door, the door having guide rollers at each side to rotate inside the guide tracks, the operating device including:

a housing having therein a reversible motor and gear reduction driving a drive shaft extending out of the housing;

a drive roller formed of resilient material connected to the drive shaft, the drive roller having a contoured surface to ride on an outside surface of one guide track;

pinch means to pinch the one guide track between one of the guide rollers of the door and the drive roller such that rotation of the drive roller frictionally drives the sliding door in the guide tracks; and attachment means on the housing for connection to the sliding door;

the improvement comprising:

slidable connection between the drive roller and the drive shaft to take into account lateral displacement of the sliding door between open and closed position of the sliding door, and slidably adjustable base for the attachment means for different thicknesses of sliding door and the guide tracks.

2. A power door operating device according to claim 1 wherein the slidable connection between the drive roller and the drive shaft comprises a drive shaft with a square cross section, and a square hole in the drive roller to allow the drive roller to slide on the drive shaft and transmit rotational movement.

3. The power door operating device according to claim 1 wherein the slidably adjustable base has a pivot between the door and the housing.

4. The power door operating device according to claim 1 wherein the pinch means comprises a toggle system with a first lever to pivot about the drive shaft, a second lever at one end hooking onto a shaft supporting the guide roller and having spring tension connection at the other end of the first lever to take into account different thicknesses of the guide track, and supply sufficient pressure when the toggle system is in a driving position for the drive roller to move the door.

5. The power door operating system according to claim 1 including two spaced apart limit switches located on the housing, and two spaced apart adjustable trip fingers adapted for mounting on the guide track, the trip fingers adapted to activate the limit switches to cancel reversing action of the motor and to turn off the motor.

* * * * *